US005078056A

United States Patent [19]

McCauley

[11] Patent Number: 5,078,056

[45] Date of Patent: Jan. 7, 1992

[54] FOLDING TABLE CONSTRUCTION

[76] Inventor: Stephanie S. McCauley, 6285 N. Ocean Blvd., Ocean Ridge, Fla. 33435

[21] Appl. No.: 306,481

[22] Filed: Feb. 3, 1989

[51] Int. Cl.[5] ..... A47B 3/00

[52] U.S. Cl. ..... 108/115; 108/129; 108/9

[58] Field of Search ..... 108/115, 116, 117, 124, 108/128, 129, 134, 135, 9

[56] References Cited

U.S. PATENT DOCUMENTS

| | | | |
|---|---|---|---|
| 70,339 | 10/1867 | Kreitz | 108/9 |
| 189,222 | 4/1877 | Hook | 108/115 |
| 275,836 | 4/1883 | McClintick | 108/124 |
| 348,706 | 9/1886 | Weiner | 108/115 |
| 934,985 | 9/1909 | Girard | 108/134 |
| 1,429,969 | 9/1922 | Palmer | 108/115 |
| 4,113,058 | 9/1978 | Kobosh | 108/135 X |

FOREIGN PATENT DOCUMENTS

| | | | |
|---|---|---|---|
| 716976 | 10/1954 | United Kingdom | 108/115 |

*Primary Examiner*—Peter A. Aschenbrenner
*Attorney, Agent, or Firm*—Jack N. McCarthy

[57] ABSTRACT

A folding table construction provides a "Z"-shaped table for use and a minimum folded shape for storing. A table top and base member are connected by a diagonal support. The table top and base member are pivotable inwardly against each side of the diagonal support for folding, and pivotable outwardly to extend from each end of the diagonal support to be ready for use. A holding and locking device is used to lock the table top and base member in their extended position.

9 Claims, 3 Drawing Sheets

FOLDING TABLE CONSTRUCTION

DESCRIPTION

1. Technical Field

This invention relates to a folding table which can be moved between an open position for use and a folded position for storage. This construction would be especially useful as a "TV snack" table.

2. Background Art

No folding tables as set forth in this application have been found; however, the following patents were uncovered in a search made in the U.S. Patent and Trademark Office: U.S. Pat. Nos. 348,706; 2,391,861; 2,545,515; 3,247,811; 3,653,626; and 4,094,257.

DISCLOSURE OF INVENTION

An object of this invention is to provide a small, sturdy, snack-type folding table.

Another object of this invention is to provide a folding "Z"-shaped table having a table top, a base member, and a diagonal support member; an angular positioning and locking member being located where said diagonal support member engages said table top and where said diagonal support member engages said base member.

A further object of this invention is to provide a "Z"-shaped folding table having one end of a diagonal support member pivotally mounted to the bottom of the table top and with the other end of said diagonal support member pivotally mounted to the top of the base member, said base member being under said table top, said diagonal support member having an angled, or beveled, surface engaging a surface on the bottom of the table top to limit the open angular movement of the table top with relation to the diagonal support member to properly position it for use; an angular positioning and locking means located between said diagonal support member and the bottom of said table top holds said surfaces against each other and prevents said table top from folding against said diagonal support member, said diagonal support member having an angled, or beveled, surface engaging a surface on the top of the base member to limit the open angular movement of the base member with relation to the diagonal support member to properly position it for use; another angular positioning and locking means located between said diagonal support member and the top of said base member holds said surfaces against each other and prevents said base member from folding against said diagonal support member.

Another object of this invention is to permit construction of folding tables of different heights by (1) varying the length of the diagonal support member between the table top and base member, (2) varying the limit of the open angular movement of the table top and base member with relation to the diagonal support member, which will include matching the angular positioning and locking means, or (3) combining (1) and (2).

A further object of this invention is to provide an angular positioning and locking member between one end of a diagonal support means and a table top means of a "Z"-shaped table, said angular positioning and locking member being pivotally mounted to one of said means and pivotable outwardly for positioning against a stop on the other means to fix said table top means for use in relation to said diagonal support means. A similar angular positioning and locking member is provided between the other end of said diagonal support means and a base means.

Another object of the invention is to provide for the movement of said angular positioning and locking members towards their positions against a stop where they fix the table top means and base means in angular relation to said diagonal support member for use.

BEST MODE FOR CARRYING OUT THE INVENTION

Figure 1:
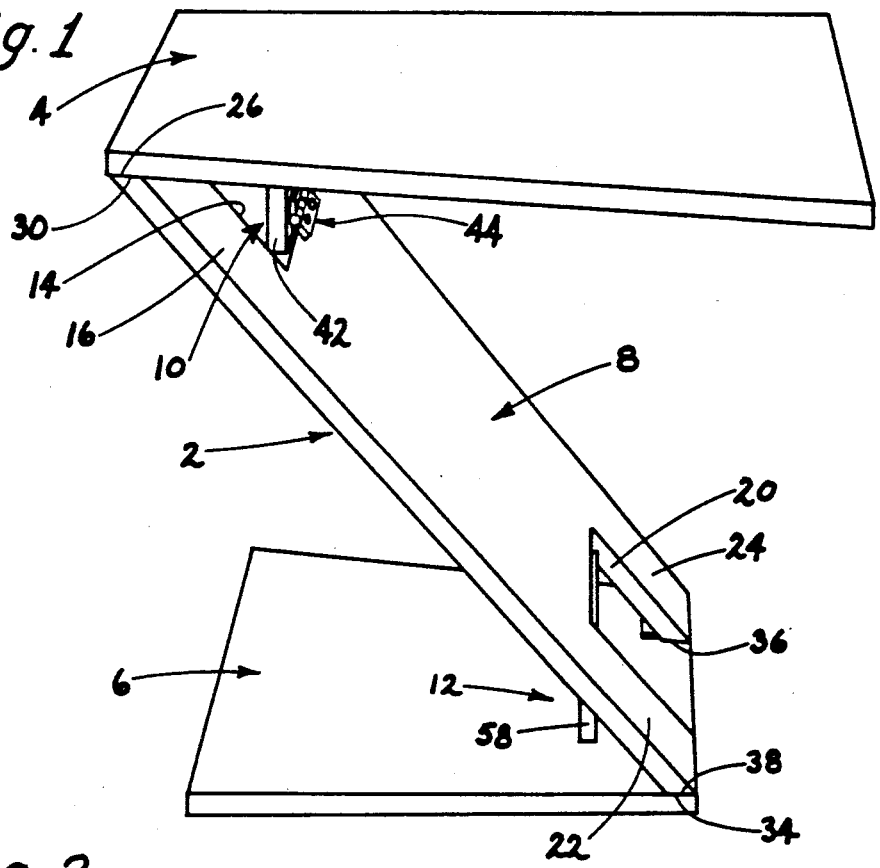
FIG. 1 is a perspective view of the folding table in an open position for use.

As set forth in FIG. 1, a folding table 2 is shown constructed having five main parts: (1) a table top 4; (2) a base member 6; (3) a diagonal support member 8; (4) an angular positioning and locking means 10 between said table top 4 and said diagonal support member 8; and (5) an angular positioning and locking means 12 between said base member 6 and diagonal support member 8. Said table top 4, base member 6, and diagonal support member 8 are all shown as flat, board-like members, with the upper end of said diagonal support member 8 pivotally connected to the bottom of said table top 4 by two hinges 9, and with the other lower end of said diagonal support member 8 pivotally connected to the top of said base member 6 by two hinges 11. This arrangement forms a "Z"-shaped folding table 2 when the table top 4 and base member 6 are pivoted to a full open position with respect to diagonal support member 8 (see FIG. 1) and when folded, said table top 4, base member 6 and diagonal support member 8 are positioned adjacent each other in a closed, flattened position for storing (see FIG. 8).

Diagonal support member 8 is formed having a cut-out opening 14, with equal length sides and a bottom surface A, at the center of its upper end, forming spaced arms 16 and 18, and having a cut-out opening 20, with equal length sides and a bottom surface B, at the center of the other lower end, forming spaced arms 22 and 24. Each end surface 26 and 28, respectively, of spaced arms 16 and 18 is formed as a beveled surface for engaging mating bottom surface areas 30 and 32, respectively, on table top 4 in a manner to be hereinafter described;

said beveled surfaces 26 and 28 being aligned with each other. Each end surface 34 and 36, respectively, of spaced arms 22 and 24, is formed as a beveled surface for engaging mating top surface areas 38 and 40, respectively, on base member 6 in a manner to be hereinafter described; said beveled surfaces 34 and 36 being aligned with each other.

The upper ends of arms 16 and 18 of diagonal support member 8 each have one hinge plate 50 of a hinge 9 fixed thereto inwardly from the beveled surfaces 26 and 28, respectively, and the bottom of said table top 4 has the other hinge plates 52 of hinges 9 fixed thereto inwardly from areas 30 and 32, respectively. Said diagonal support member 8 and table top 4 are spaced apart at the pivot point of hinges 9 to permit beveled surfaces 26 and 28 to contact areas 30 and 32 in the full open position of the "Z"-shaped folding table 2 at a desired angle between diagonal support member 8 and table top 4.

The lower ends of arms 22 and 24 of diagonal support member 8 each have one hinge plate 54 of a hinge 11 fixed thereto inwardly from the beveled surfaces 34 and 36, respectively, and the top of said base member 6 has the other hinge plates 56 of hinges 11 fixed thereto inwardly from areas 38 and 40, respectively. Said diagonal support member 8 and base member 6 are spaced apart at the pivot point of hinges 11 to permit beveled surfaces 34 and 36 to contact areas 38 and 40 in the full open position of the "Z"-shaped folding table 2 at a desired angle between diagonal support member 8 and base member 6.

Angular and positioning locking means 10 is provided for releasable engagement between said diagonal support member 8 and the bottom of said table top 4 and said other angular positioning and locking means 12 is provided for releasable engagement between said diagonal support member 8 and the top of said base member 6. The angular positioning and locking means 10 comprises an arm, or small, flat, rectangular board-like, lock member 42 pivotally mounted adjacent its bottom edge to the upper part of diagonal support member 8 by a hinge 44. Arm lock member 42 fits in cut-out opening 14 with its bottom edge adjacent bottom surface A of cut-out opening 14, and a stop member 46 on the bottom surface of said table top 4 limits the upward pivotal angular movement of the member 42 at a predetermined angle and fixes it in this position when the folding table 2 is in its open position.

The angular positioning and locking means 12 comprises an arm, or small, flat, rectangular board-like, lock member 58 pivotally mounted adjacent its top edge to the lower part of diagonal support member 8 by a hinge 60. Arm lock member 58 fits in cut-out opening 20, with its top edge adjacent bottom surface B of cut-out opening 20, and a stop member 62 on the top surface of said base member 6 limits the downward pivotal angular movement of the member 58 at a predetermined angle and fixes it in this position when the folding table 2 is in its open position.

Figure 2:
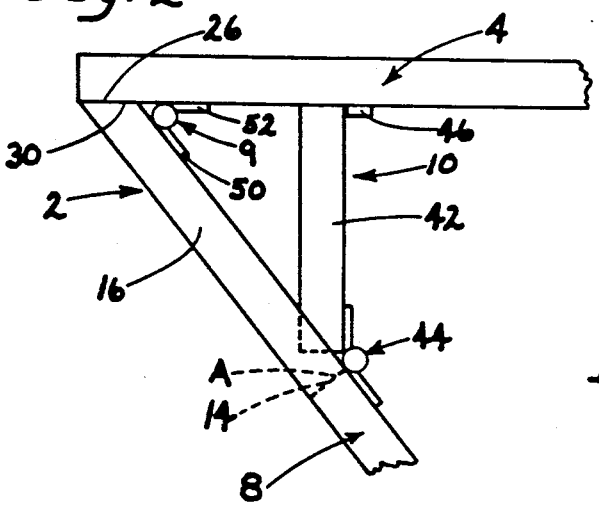
FIG. 2 is a fragmentary side view of the connection of the table top to the diagonal support member as it is viewed in FIG. 1.

The arm lock member 42 is made of a length so that as it pivots upwardly, it wedges, or is forced, against the bottom of table top 4 as the beveled surfaces 26 and 28 engage bottom surface areas 30 and 32, respectively, of table top 4, and arm lock member 42 is positioned 90° to the bottom of table top 4 (see FIG. 2). To prevent the arm lock member 42 from accidentally pivoting towards diagonal support member 8 to allow the table top 4 to drop, the stop member 46 is located so that the arm lock member 42 will be positioned against stop member 46 just over the 90° center engaging position of arm lock member 42 and table top 4.

Figure 3:
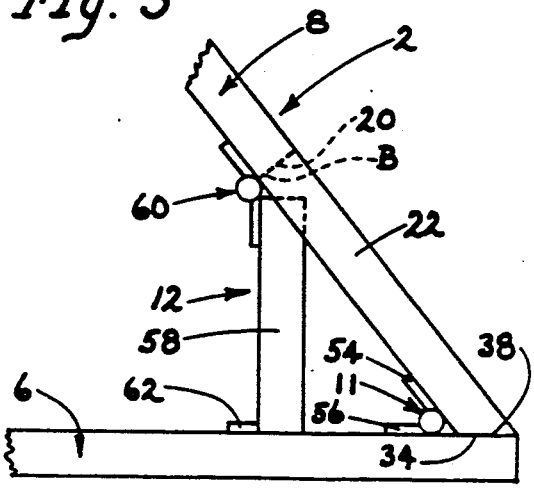
FIG. 3 is a fragmentary side view of the connection of the base member of the table to the diagonal support member as it is viewed in FIG. 1.
Figure 4:
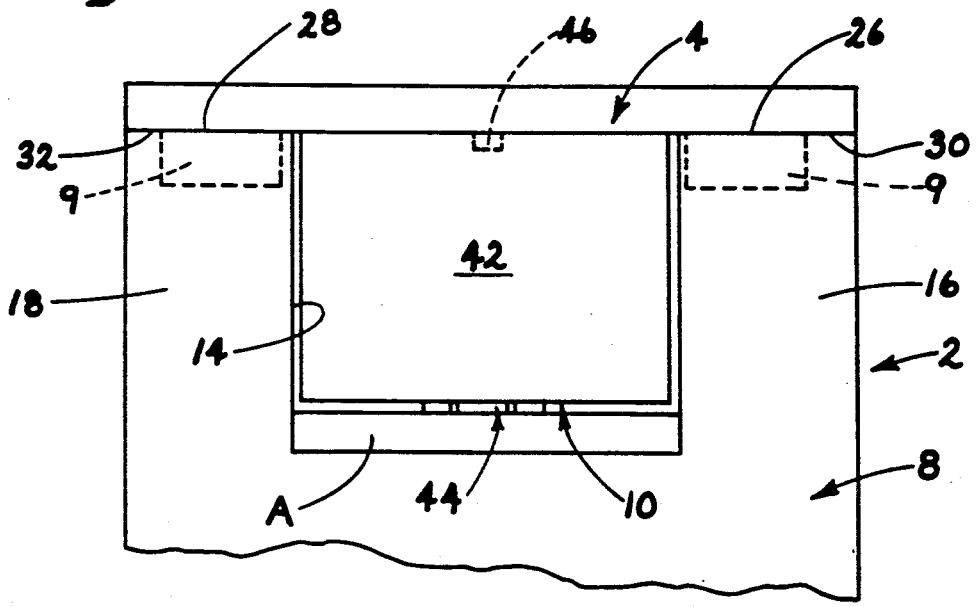
FIG. 4 is a fragmentary end view of the top of the folding table as it is viewed from the left in FIG. 1.
Figure 5:
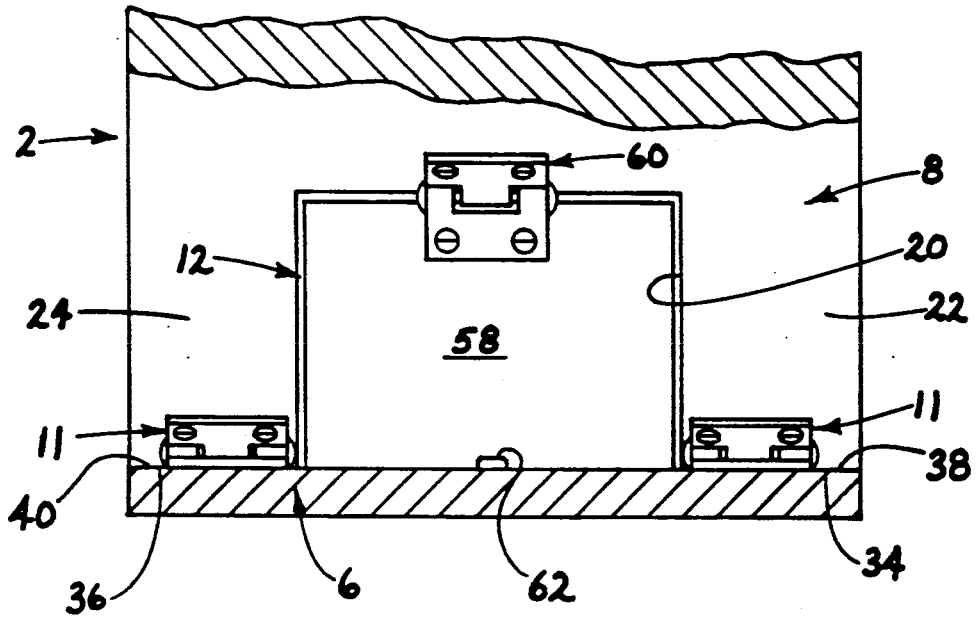
FIG. 5 is a fragmentary end view of the bottom of the folding table as it is viewed from the left in FIG. 1.
Figure 6:
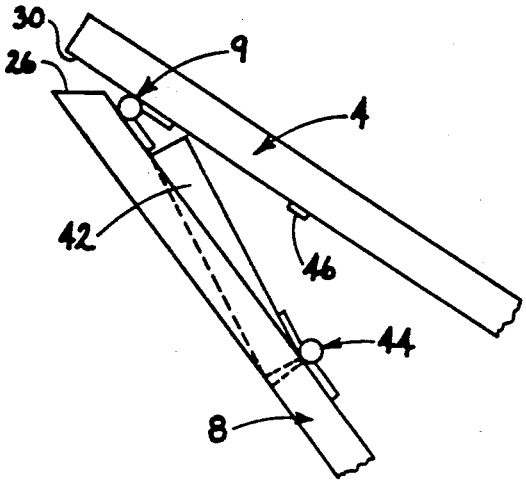
FIG. 6 is a view similar to FIG. 2 showing the table top in an intermediate folded position towards the diagonal support member.
Figure 7:
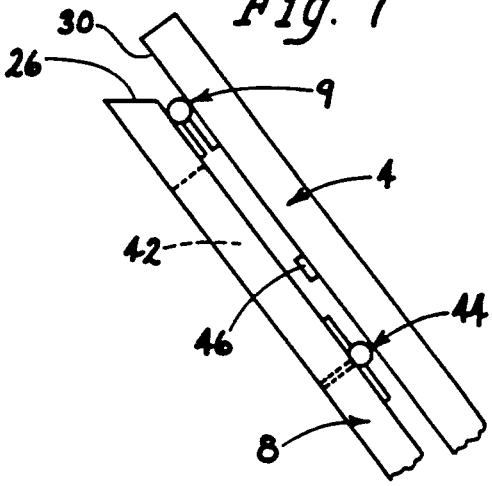
FIG. 7 is a view similar to FIG. 2 showing the table top in a fully folded position towards the diagonal support member.

The arm lock member 58 is made of a length so that as it pivots downwardly, it wedges, or is forced, against the top of base member 6 as the beveled surfaces 34 and 36 engage bottom surface areas 38 and 40, respectively, of base member 6 and arm lock member 58 is positioned 90° to the top of base member 6 (see FIG. 3). To prevent the arm lock member 58 from accidentally pivoting towards diagonal support member 8 to allow the diagonal support member 8 and table top 4 to drop, the stop member 62 is located so that the arm lock member 58 will be positioned against stop member 62 just over the 90° center engaging position of board-like member 58 and base member 6.

The angle of the beveled surfaces 26 and 28 forms the desired angle between the diagonal support member 8 and the table top 4, and the angle of the beveled surfaces 34 and 36 forms the desired angle between the diagonal support member 8 and the base member 6.

Figure 8:
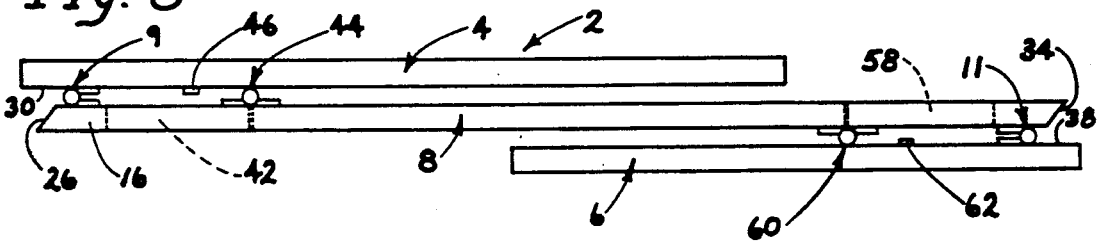
FIG. 8 is a side view of a folding table in its fully folded position for storing.

In operation, if the folding table 2 is in its full open position for use (see FIG. 1), the arm lock members 42 and 58 are pushed by hand away from the stop members 46 and 62, respectively, towards diagonal support member 8, releasing the table top 4 and base member 6 so they can close against the diagonal support member 8 (see FIG. 8). If the folding table 2 is in its closed position for storing (see FIG. 8) the table top 4 and base member 6 are pivoted away from diagonal support member 8 until the beveled surfaces 26 and 28 engage the surfaces 30 and 32 (see FIG. 2) and the beveled surfaces 34 and 36 engage the surfaces 38 and 40 (see FIG. 3), then the arm lock members 42 and 58 are pushed by hand against the stop members 46 and 62, respectively, locking the folding table 2 in place for use.

Figure 9:
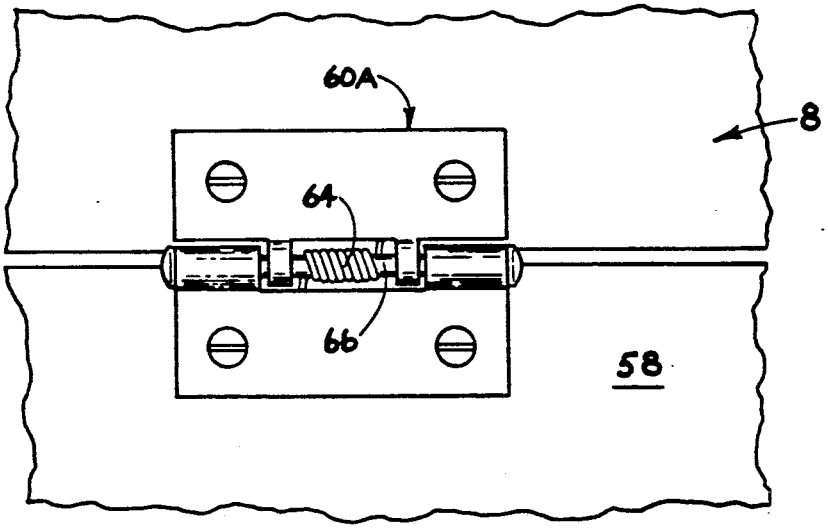
FIG. 9 is an enlarged view of a modification of the hinge member as shown in FIG. 5 between the diagonal support member and the hinged positioning and locking member, said hinge being biased by a spring to a closed hinge position.

FIG. 9 shows a hinge 60A with a spring 64 mounted around the hinge pin 66 with the ends of the spring extending under the hinge plates. The biasing effect of the spring 64 biases the hinge plates of the hinge 60A to a closed position. This construction permits the arm lock member 58 to be biased towards and into its position of FIG. 3. When hinge 44 is made in the same manner as hinge 60A, the arm lock member 42 is also biased towards and into its position of FIG. 2. When a folding table 2, made in this manner, is opened from a folded position, as in FIG. 8, the arm lock members 42 and 58 will be biased to move to their extended positions, as in FIG. 1, without being moved by hand, as they were without biasing means. This action provides for ease in opening.

While ordinary hinges 44 and 60 have been shown to provide the pivotal mounting of the arm lock members 42 and 58, respectively, other known pivotal means can be used. Further, the hinges 44 and 60 can be located in other positions to hinge the arm lock members 42 and 58, respectively, between the diagonal support member 8 and the table top 4 and base member 6. In construction, other bias means can be used in place of spring 64 to provide the opening effect as discussed for FIG. 9.

In constructing folding tables 2, they can be made of varying heights by (1) controlling the length of the diagonal support member 8, and/or (2) controlling the angle of the table top 4 and the base member 6 to the diagonal support member 8.

A folding table 2 was built similar to FIG. 1 where the height was 2 feet and the angle between the diagonal support member 8 and the table top 4 and the base member 6 were both made 50°, positioning the table top 4 and base member 6 parallel to each other. The diagonal support member 8 was made approximately 29" in length, with each arm lock member 42, and 58, being pivoted at approximately 5¾" from the cooperating end of each surface of said diagonal support member 8 that it was pivoted on. Each arm lock member 42, and 58, was made approximately 4¼" in length.

If a folding table 2 is desired having a slanted table top 4, the beveled surfaces 26 and 28 can be made a smaller angle than beveled surfaces 34 and 36, such as 35°. Cut-out openings 14 and 20 can be formed as recesses and receive a thinner arm lock member 42 and 58, respectively, therein if desired. Further, the ends of arm lock members 42 and 58 can be made to be flat against table top 4 and base member 6 when in position against the stop members 46 and 62, respectively.

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. A folding table having a table top means, said table top means having an upper and lower surface, a diagonal support means having upper and lower ends, a base means, said base means having an upper and lower surface, first pivot means pivotally connecting the lower surface of said table top means adjacent to one end of said diagonal support means on one side thereof, second pivot means pivotally connecting the upper surface of said base means adjacent to the other end of said diagonal support means on the other side thereof, said table top means extending over said diagonal support means, said base means extending under said diagonal support means, said table top means being pivotable in relation to said diagonal support means so that in a first position it can be positioned substantially flat adjacent one side of said diagonal support means and in a second position it can extend outwardly at an angle from said one side of said diagonal support means, means adjacent said first pivot means for releasably locking said table top means and said diagonal support means at their second position, said base means being pivotable in relation to said diagonal support means so that in a first position it can be positioned substantially flat adjacent the other side of said diagonal support means and in a second position it can extend outwardly at an angle from said other side of said diagonal support means, means adjacent said second pivot means for releasably locking said base means and said diagonal support means at their second position, said table top means and said diagonal support means each having a mating surface thereon to engage each other when said table top means is removed from its first position to its second position to extend outwardly at an angle from said one side of said diagonal support means and set a desired angle between said table top means and said diagonal support means, said means for releasably locking said table top means and said diagonal support means at said desired angle with said mating surfaces engaging each other includes a short arm means having two ends, means pivotally mounting said short arm means at one end between said table top means and the upper part of said diagonal support means adjacent said first pivot means so that the short arm means can be directly pivoted to a locking position forcing said table top means and said diagonal support means apart at the desired angle pressing said mating surfaces together, said means pivotally mounting said short arm means is located on the upper part of said diagonal support means, cut-out means being positioned in said diagonal support means above said pivotal mounting means, said cut-out means opening to said one side of said diagonal support means to receive said short arms means when pivoted away from locking said table top means and said diagonal support means at the desired angle so that said table top means can be positioned substantially flat with said diagonal support means.

2. A folding table having a table top means, said table top means having an upper and lower surface, a diagonal support means having upper and lower ends, a base means, said base means having an upper and lower surface, first pivot means pivotally connecting the lower surface of said table top means adjacent to one end of said diagonal support means on one side thereof, second pivot means pivotally connecting the upper surface of said base means adjacent to the other end of said diagonal support means on the other side thereof, said table top means extending over said diagonal support means, said base means extending under said diagonal support means, said table top means being pivotable in relation to said diagonal support means so that in a first position it can be positioned substantially flat adjacent one side of said diagonal support means and in a second position it can extend outwardly at an angle from said one side of said diagonal support means, means adjacent said first pivot means for releasably locking said table top means and said diagonal support means at their second position, said base means being pivotable in relation to said diagonal support means so that in a first position it can be positioned substantially flat adjacent the other side of said diagonal support means and in a second position it can extend outwardly at an angle from said other side of said diagonal support means, means adjacent said second pivot means for releasably locking said base means and said diagonal support means at their second position, said base means and said diagonal support means each have a mating surface thereon to engage each other when said base means is moved from its first position to its second position to extend outwardly at an angle from said other side of said diagonal support means and set a desired angle between said base means and said diagonal support means, said means for releasably locking said base means and said diagonal support means at said desired angle with said mating surfaces engaging each other includes a second short arm means having two ends, means pivotally mounting said second short arm means at one end between said base means and the lower part of said diagonal support means adjacent said second pivot means so that the second short arm means can be directly pivoted to a locking position forcing said base means and diagonal support means apart at the desired angle pressing said mating surfaces together, said means pivotally mounting said second short arm means is located on the lower part of said diagonal support means, cut-out means being positioned in said diagonal support means below said pivotal mounting means, said cut-out means opening to said other side of said diagonal support means to receive said second short arm means when pivoted away from locking said base means and said diagonal support means at the desired angle so that said base means can be positioned substantially flat with said diagonal support means.

3. A folding table being foldable between a "Z"-shaped for use and a flat position for storing, said table having a table top member with a front and back end, a bottom base member with a front and back end, a diagonal support member with an upper and lower end extending between the back end of said table top member and the front end of said bottom base member, first pivot means pivotally connecting said table top member and said diagonal support member adjacent said back end of said table top member and the upper end of said diagonal support member for folding or unfolding said table top member, second pivot means pivotally connecting said bottom base member and said diagonal support member adjacent said front end of said bottom base member and the lower end of said diagonal support member for folding or unfolding said bottom base member, a first and second short arm means, third pivot means pivotally connecting one end of said first short arm means to the upper part of said diagonal support member a short distance below the upper end of said diagonal support member, said table top member and said diagonal support member having spaced surfaces which become engaged to limit the extent of opening angular movement between said table top member and said diagonal support member, said first short arm means being pivoted about said third pivot means so that its other end can be pivoted to be positioned against the table top member when said spaced surfaces are engaged to hold said table top member and said diagonal support member in that position, fourth pivot means pivotally connecting one end of said second short arm means to the lower part of said diagonal support member a short distance above the lower end of said diagonal support member, said bottom base member and said diagonal support member having spaced surfaces which become engaged to limit the extent of opening angular movement between said bottom base member and said diagonal support member, said second short arm means being pivoted about said fourth pivot means so that its other end can be pivoted to be positioned against the bottom base member when said spaced surfaces are engaged to hold said bottom base member and diagonal support member in that position, said diagonal support member has first cut-out means to receive said first short arm means when said table top member is folded for storing, and said diagonal support member has second cut-out means to receive said second short arm means when said bottom base member is folded for storing, a projecting stop means on said table top member for positioning the other end of said first short arm means along with said table top member when said table top member is unfolded for use.

4. A folding table being foldable between a "Z"-shape for use and a flat position for storing, said table having a table top member with a front and back end, a bottom base member with a front and back end, a diagonal support member with an upper and lower end extending between the back end of said table top member and the front end of said bottom base member, first pivot means pivotally connecting said table top member and said diagonal support member adjacent said back end of said table top member and the upper end of said diagonal support member for folding or unfolding said table top member, second pivot means pivotally connecting said bottom base member and said diagonal support member adjacent said front end of said bottom base member and the lower end of said diagonal support member for folding or unfolding said bottom base member, a first and second short arm means, third pivot means pivotally connecting one end of said first short arm means to the upper part of said diagonal support member a short distance below the upper end of said diagonal support member, said table top member and said diagonal support member having spaced surfaces which become engaged to limit the extent of opening angular movement between said table top member and said diagonal support member, said first short arm means being pivoted about said third pivot means so that its other end can be pivoted to be positioned against the table top member when said spaced surfaces are engaged to hold said table top member and said diagonal support member in that position, fourth pivot means pivotally connecting one end of said second short arm means to the lower part of said diagonal support member a short distance above the lower end of said diagonal support member, said bottom base member and said diagonal support member having spaced surfaces which become engaged to limit the extent of opening angular movement between said bottom base member and said diagonal support member, said second short arm means being pivoted about said fourth pivot means so that its other end can be pivoted to be positioned against the bottom base member when said spaced surfaces are engaged to hold said bottom base member and diagonal support member in that position, said diagonal support member has first cut-out means to receive said first short arm means when said table top member is folded for storing, and said diagonal support member has second cut-out means to receive said second short arm means when said bottom base member is folded for storing, a projecting stop means on said table top member for positioning the other end of said first short arm means along with said table top member when said table top member is unfolded for us, said first cut-out means extends through said diagonal support member at its upper end forming a projection on each side thereof, said space surfaces on said diagonal support member being located on the ends of said projections for engaging said table top member, said second cut-out means extends through said diagonal support member at its lower end forming a projection on each side, said spaced surfaces on said diagonal support member being located on the ends of said projections for engaging said bottom base member, said first short arm means comprising a first short rectangular member, said second short arm means comprising a second short rectangular member, said first short rectangular member being received by said first cut-out means when said table top member is folded to a flat position adjacent said diagonal support member for storing, said second short rectangular member being received by said second cut-out means when said bottom base member is folded to a flat position adjacent said diagonal support member for storing.

5. A folding table having a table top means, said table top means having an upper and lower surface, a diagonal support means having upper and lower ends, a base means, said base means having an upper and lower surface, first pivot means pivotally connecting the lower surface of said table top means adjacent to one end of said diagonal support means on one side thereof, second pivot means pivotally connecting the upper surface of said base means adjacent to the other end of said diagonal support means on the other side thereof, said table top means extending over said diagonal support means, said base means extending under said diagonal support means, said table top means being pivotable in relation to said diagonal support means so that in a first position it can be positioned substantially flat adjacent one side of said diagonal support means and in a second position it can extend outwardly at an angle from said one side of said diagonal support means, means adjacent said first pivot means for releasably locking said table top means and said diagonal support means at their second position, said base means being pivotable in relation to said diagonal support means so that in a first position it can be positioned substantially flat adjacent the other side of said diagonal support means and in a second position it can extend outwardly at an angle from said other side of said diagonal support means, means adjacent said second pivot means for releasably locking said base means and said diagonal support means at their second position, said table top means and said diagonal support means each have a mating surface thereon to engage each other when said table top means is moved from its first position to its second position to extend outwardly at an angle from said one side of said diagonal support means and set a desired angle between said table top means and said diagonal support means, said means for releasably locking said table top means and said diagonal support means at said desired angle with said mating surfaces engaging each other includes a short arm means having two ends, means pivotally mounting said short arm means at one end between said table top means and the upper part of said diagonal support means adjacent said first pivot means so that the short arm means can be directly pivoted to a locking position forcing said table top means and said diagonal support means apart at the desired angle pressing said mating surfaces together, biasing means for biasing said short arm means to maintain a biasing force between said table top means and said diagonal support means as they move between their first and second position.

6. A folding table having a table top means, said table top means having an upper and lower surface, a diagonal support means having upper and lower ends, a base means, said base means having an upper and lower surface, first pivot means pivotally connecting the lower surface of said table top means adjacent to one end of said diagonal support means on one side thereof, second pivot means pivotally connecting the upper surface of said base means adjacent to the other end of said diagonal support means on the other side thereof, said table top means extending over said diagonal support means, said base means extending under said diagonal support means, said table top means being pivotable in relation to said diagonal support means so that in a first position it can be positioned substantially flat adjacent one side of said diagonal support means and in a second position it can extend outwardly at an angle from said one side of said diagonal support means, means adjacent said first pivot means for releasably locking said table top means and said diagonal support means at their second position, said base means being pivotable in relation to said diagonal support means so that in a first position it can be positioned substantially flat adjacent the other side of said diagonal support means and in a second position it can extend outwardly at an angle from said other side of said diagonal support means, means adjacent said second pivot means for releasably locking said base means and said diagonal support means at their second position, said table top means and said diagonal support means each have a mating surface thereon the engage each other when said table top means is moved from its first position to its second position to extend outwardly at an angle from said one side of said diagonal support means and set a desired angle between said table top means and said diagonal support means, said means for releasably locking said table top means and said diagonal support means at said desired angle with said mating surface engaging each other includes a short arm means having two ends, means pivotally mounting said short arm means at one end between said table top means and the upper part of said diagonal support means adjacent said first pivot means so that the short arm means can be directly pivoted to a locking position forcing said table top means and said diagonal support means apart at the desired angle pressing said mating surfaces together, projecting stop means for stopping said arm means as it is pivoted to its locking position at the second position of said table top means and said diagonal support means, biasing means for biasing said short arm means against said projecting stop means to maintain a locking position of said short arm means.

7. A folding table having a table top means, said table top means having an upper and lower surface, a diagonal support means having upper and lower ends, a base means, said base means having an upper and lower surface, first pivot means pivotally connecting the lower surface of said table top means adjacent to one end of said diagonal support means on one side thereof, second pivot means pivotally connecting the upper surface of said base means adjacent to the other end of said diagonal support means on the other side thereof, said table top means extending over said diagonal support means, said base means extending under said diagonal support means, said table top means being pivotable in relation to said diagonal support means so that in a first position it can be positioned substantially flat adjacent one side of said diagonal support means and in a second position it can extend outwardly at an angle from said one side of said diagonal support means, means for releasably locking said table top means and said diagonal support means at their second position, said base means being pivotable in relation to said diagonal support means so that in a first position it can be positioned substantially flat adjacent the other side of said diagonal support means and in a second position it can extend outwardly at an angle from said other side of said diagonal support means, means for releasably locking said base means and said diagonal support means at their second position, said table top means and said diagonal support means each have a mating surface thereon to engage each other when said table top means is moved from its first position to its second position to extend outwardly at an angle from said one side of said diagonal support means and set a desired angle between said table top means and said diagonal support means, said mating surface on said table top means is on its lower surface between one end thereof and said first pivot means, said mating surface on said diagonal support means being on its upper end surface, said means for releasably locking said table top means and said diagonal support means at said desired angle with said mating surfaces engaging each other includes a short arm means having two ends, third pivot means pivotally connecting one end of said short arm means to the upper part of said diagonal support means so that the short arm means can be pivoted to a locking position where the other end of said short arm means contacts said table top means to wedge said table top means and said diagonal support means apart at the desired angle pressing said mating surfaces together, a cut-out means at the upper end of said diagonal support member above said third pivot means, said cut-out means receiving said short arm means when said table top member is in its first position.

8. A folding table having a table top means, said table top means having an upper and lower surface, a diagonal support means having upper and lower ends, a base means, said base means having an upper and lower surface, first pivot means pivotally connecting the lower surface of said table top means adjacent to one end of said diagonal support means on one side thereof, second pivot means pivotally connecting the upper surface of said base means adjacent to the other end of said diagonal support means on the other side thereof, said table top means extending over said diagonal support means, said base means extending under said diagonal support means, said table top means being pivotable in relation to said diagonal support means so that in a first position it can be positioned substantially flat adjacent one side of said diagonal support means and in a second position it can extend outwardly at an angle from said one side of said diagonal support means, means for releasably locking said table top means and said diagonal support means at their second position, said base means being pivotable in relation to said diagonal support means so that in a first position it can be positioned substantially flat adjacent the other side of said diagonal support means and in a second position it can extend outwardly at an angle from said other side of said diagonal support means, means for releasably locking said base means and said diagonal support means at their second position, said table top means and said diagonal support means each have a mating surface thereon to engage each other when said table top means is moved from its first position to its second position to extend outwardly at an angle from said one side of said diagonal support means and set a desired angle between said table top means and said diagonal support means, said mating surface on said table top means is on its lower surface between one end thereof and said first pivot means, said mating surface on said diagonal support means being on its upper end surface, said means for releasably locking said table top means and said diagonal support means at said desired angle with said mating surfaces engaging each other includes a short arm means having two ends, third pivot means pivotally connecting one end of said short arm means to the upper part of said diagonal support means so that the short arm means can be pivoted to a locking position where the other end of said short arm means contacts said table top means to wedge said table top means and said diagonal support means apart at the desired angle pressing said mating surfaces together, a projecting stop means for stopping said short arm means as it is pivoted about said third pivot means to its locking position when it wedges said table top means and said diagonal support means apart at the desired angle pressing said mating surfaces together, biasing means for biasing said short arm means towards said projecting stop means.

9. A folding table being foldable between a "Z"-shape for use and a flat position for storing, said table having a table top member with a front and back end, a bottom base member with a front and back end, a diagonal support member with an upper and lower end extending between the back end of said table top member and the front end of said bottom base member, first pivot means pivotally connecting said table top member and said diagonal support member adjacent said back end of said table top member and the upper end of said diagonal support member for folding or unfolding said table top member, second pivot means pivotally connecting said bottom base member and said diagonal support member adjacent said front end of said bottom base member and the lower end of said diagonal support member for folding or unfolding said bottom base member, a first and second short arm means, third pivot means pivotally connecting one end of said first short arm means to the upper part of said diagonal support member a short distance below the upper end of said diagonal support member, said table top member and said diagonal support member having spaced surfaces which become engaged to limit the extent of opening angular movement between said table top member and said diagonal support member, said first short arm means being pivoted about said third pivot means so that its other end can be pivoted to be positioned against the table top member when said spaced surfaces are engaged to hold said table top member and said diagonal support member in that position, fourth pivot means pivotally connecting one end of said second short arm means to the lower part of said diagonal support member a short distance above the lower end of said diagonal support member, said bottom base member and said diagonal support member having spaced surfaces which become engaged to limit the extent of opening angular movement between said bottom base member and said diagonal support member, said second short arm means being pivoted about said fourth pivot means so that its other end can be pivoted to be positioned against the bottom base member when said spaced surfaces are engaged to hold said bottom base member and diagonal support member in that position, said diagonal support member has first cut-out means to receive said first short arm means when said table top member is folded for storing, and said diagonal support member has second cut-out means to receive said second short arm means when said bottom base member is folded for storing, a projecting stop means on said table top member for positioning the other end of said first short arm means along with said table top member when said table top member is unfolded for use, biasing means for biasing said first short arm means out of said first cut-out means against said table top member to position said first short arm means against said projecting stop means.

* * * * *